United States Patent [19]

Smith

[11] 4,423,681

[45] Jan. 3, 1984

[54] OFFSET LITHO CONVERSION FROM LETTERPRESS EQUIPMENT

[75] Inventor: Gary R. Smith, Overland Park, Kans.

[73] Assignee: Smith RPM Corporation, Overland Park, Kans.

[21] Appl. No.: 348,136

[22] Filed: Feb. 11, 1982

Related U.S. Application Data

[60] Division of Ser. No. 86,717, Oct. 22, 1979, and Ser. No. 12,567, Feb. 15, 1979, Pat. No. 4,286,519, and a continuation-in-part of Ser. No. 936,130, Aug. 23, 1978, abandoned.

[51] Int. Cl.[3] ..... B41L 17/12; B41F 27/00

[52] U.S. Cl. ..... 101/451; 101/138; 101/177; 101/221; 101/DIG. 28

[58] Field of Search ..... 101/138, 221, DIG. 28, 101/451, 177, 137, 217, 220

[56] References Cited

U.S. PATENT DOCUMENTS

| | | | |
|---|---|---|---|
| 1,517,969 | 12/1924 | Evans et al. | 101/218 |
| 1,653,198 | 12/1927 | Belcher | 101/177 |
| 1,854,867 | 4/1932 | Stahler | 101/144 |
| 2,024,813 | 12/1935 | Barber | 101/177 |
| 2,224,391 | 12/1940 | Heubner | 101/138 |
| 2,270,272 | 1/1942 | Davidson | 101/217 |
| 2,270,273 | 1/1942 | Davidson | 101/217 |
| 2,435,791 | 2/1948 | Luehrs | 101/180 |
| 2,716,942 | 9/1955 | Timson et al. | 101/144 |
| 2,909,117 | 10/1959 | Crissy | 101/137 |
| 3,072,050 | 1/1963 | Wolff | 101/177 |
| 3,172,359 | 3/1965 | Dickerson | 101/217 |
| 3,203,346 | 8/1965 | Norton et al. | 101/217 |
| 3,247,790 | 4/1966 | Nash | 101/137 |
| 3,521,559 | 7/1970 | Sojeck | 101/137 |
| 3,986,454 | 10/1976 | Granger | 101/177 |

FOREIGN PATENT DOCUMENTS

| | | | |
|---|---|---|---|
| 411312 | 3/1925 | Fed. Rep. of Germany | 101/137 |
| 462357 | 7/1928 | Fed. Rep. of Germany | 101/181 |
| 2024482 | 12/1971 | Fed. Rep. of Germany | 101/220 |
| 789782 | 8/1935 | France | 101/181 |
| 630773 | 12/1961 | Italy | 101/181 |
| 52-32705 | 3/1977 | Japan . | |
| 52-70602 | 6/1977 | Japan . | |
| 52-74408 | 6/1977 | Japan . | |
| 53-71903 | 6/1978 | Japan . | |
| 53-82508 | 7/1978 | Japan . | |
| 53-140106 | 12/1978 | Japan . | |
| 54-4602 | 1/1979 | Japan . | |
| 54-98808 | 8/1979 | Japan . | |
| 55-28888 | 2/1980 | Japan . | |
| 5285 | of 1915 | United Kingdom . | |
| 606393 | 8/1948 | United Kingdom | 101/220 |
| 686864 | 2/1953 | United Kingdom | 101/181 |
| 957265 | 5/1964 | United Kingdom | 101/217 |
| 1203968 | 9/1970 | United Kingdom . | |

OTHER PUBLICATIONS

J. R. Werner, Japan "The Facinating Technological Developments in the Land of the Rising Sun" from R.I. Bulletin, Sep. 7, 1978, pp. 351 to 355.

*Primary Examiner*—Clyde I. Coughenour
*Attorney, Agent, or Firm*—Litman, Day & McMahon

[57] ABSTRACT

Web letterpress equipment is converted to offset lithographic equipment by modification of a driven letterpress impression cylinder to receive an offset blanket, thereby producing an offset blanket cylinder. A letterpress plate cylinder is modified to become an offset plate cylinder with accompanying offset inking and dampening equipment. In one embodiment, a driven letterpress plate cylinder of a color hump is packed to become an offset impression cylinder cooperating with the offset blanket cylinder. In a second embodiment, the letterpress plate cylinder of the color hump is modified to an offset color plate cylinder and a driven offset impression cylinder is added to cooperate with the offset printed on one side of a web. When used in combination with similarly converted letterpress plate, impression and color hump plate cylinders, at least three colors may be offset printed on one side of a web or multiple colors printed on opposite sides thereof. The press tower is rewebbed to print with proper registration in the bight between the respective offset blanket cylinders and offset impression cylinders.

5 Claims, 7 Drawing Figures

OFFSET LITHO CONVERSION FROM LETTERPRESS EQUIPMENT

CROSS-REFERENCE TO RELATED APPLICATIONS

The present application is a division of pending U.S. application Ser. No. 86,717 filed Oct. 22, 1979 and U.S. application Ser. No. 12,567, now U.S. Pat. No. 4,286,519 filed Feb. 15, 1979 both entitled OFFSET LITHO CONVERSION FROM LETTERPRESS EQUIPMENT and is a continuation-in-part of Ser. No. 936,130, filed Aug. 23, 1978, now abandoned, which was copending with Ser. No. 12,567.

BACKGROUND OF THE INVENTION

This application relates to web printing presses and more particularly to the conversion of web letterpress equipment, of the type heretofore commonly used for printing newspapers, to offset lithographic equipment which utilizes an offset blanket to transfer the image.

Due in part to the considerable convenience and savings that modern methods of producing lithographic plates provide over letterpress plate methods, there has been substantial recent interest, particularly among newspapers, in converting letterpress equipment to offset lithographic equipment. In converting such letterpress equipment to offset litho, each printing unit is suitably equipped with a water dampening device whereby the necessary moisture for proper image separation is provided. Also, the conversion usually involves the "packing" or "saddling" of the thin litho plates (compared to letterpress plates) to bring them up to the printing height of the letterpress plates, for which the equipment was designed.

The advantages of such offset litho conversion, in comparison to investing in new web offset presses, include monetary savings and less printing down time for the change required to modernize letterpress equipment, as well as the ability to obtain additional life out of existing such equipment. However, even though the monetary savings by conversion are substantial, the cost to effect the conversion is considerable and sometimes prohibitive.

This invention is concerned with reducing the cost of the conversion to the point where it becomes economical under most conditions. Such conversions are of equipment which include common letterpress equipment having or adpated to receive, color humps, that is, an additional letterpress plate cylinder in a tower so that two letterpress plate cylinders are cooperating with a single letterpress blanket or impression cylinder.

By way of explanation, letterpress equipment, especially newspaper web letterpress equipment, generally comprises multiple printing towers, each of which includes a letterpress plate cylinder and a letterpress impression roll or cylinder driven in cooperative relation, with the web wrapped about the impression cylinder over an included angle of about ninety to about three hundred degrees, thereby utilizing the impression cylinder to aid in driving the web and maintaining registry with other printing units. Certain of the printing towers have an additional letterpress plate cylinder cooperating with the letterpress impression cylinder, producing a so-called "color hump" by which a color image may be printed during the same web pass through the tower. In letterpress equipment where a "color hump" is used, the web wraps around the impression cylinder and is engaged by both plate cylinders. Those towers which do not have color hump cylinders are often constructed so that such cylinders can be easily added.

The amount of web wrap around the letterpress impression cylinder is believed to be far in excess of that necessary, but the letterpress equipment was so designed because this helped insure proper registration, it simplified structure and there appeared to be no appreciable adverse effects in doing so.

Many printing applications require the use of at least two color print, therefore it is advantageous to be able to convert letterpress equipment to offset lithographic having the ability to print two or more colors on one side of a web. Again because of monetary considerations, it is important to provide a simple and relatively inexpensive method of adding offset "color" printing in combination with offset "black" print. (It should be noted that the term "black" normally refers to the color first printed by a tower, whereas "color" refers to the second color printed therein. In fact the "black" cylinder may print any color and the "color" cylinders could print black.)

In practice of this invention, a letterpress impression cylinder is modified to receive an offset blanket and one of the letterpress plate cylinders is adapted to carry a lithographic offset plate, with associated inking and dampening equipment.

In one embodiment of the present invention a second letterpress plate cylinder, normally the color hump cylinder, is packed so as to become an offset impression cylinder. The web may then be fed, with substantially less wrap about the letterpress impression cylinder (now the offset blanket cylinder), through the bight between the offset blanket cylinder and the offset impression cylinder. Since both the offset blanket cylinder and the offset impression cylinder are driven, if desired for registration purposes, increased wrap may be utilized about the offset impression cylinder by adjusting the position of suitable idler rolls. To facilitate the modified webbing, the three cylinders are driven in the opposite direction than normally used for letterpress purposes, however, this generally does not present a problem since common letterpress equipment is designed to anticipate the rollers being driven in either direction.

In another embodiment of the present invention, the second "color hump" letterpress plate cylinder is converted to an offset color plate cylinder with dampening and inking equipment and a driven offset impression cylinder is added to cooperate with the offset blanket cylinder. Images are transferred from both offset plate cylinders to the offset blanket cylinder creating a reverse multicolor image on the offset blanket cylinder. The web is guided through the bight between the offset blanket cylinder and the offset impression cylinder. The multicolor image is transferred to the web from the offset blanket cylinder, whereby at least two colors are offset printed on one side of a web.

In another embodiment, additional letterpress equipment is converted to offset lithographic as described. This second converted offset lithographic press cooperates with the first, in conjunction with a web properly fed through both and registered therewith, to print at least two offset colors on one side of a web with at least one offset color being printed on an opposite side thereof or alternatively, to print at least three offset colors on one side of a web.

OBJECTS AND SUMMARY OF THE INVENTION

Therefore the principal objects of the present invention are: to provide an improved method for converting web letterpress printing equipment to offset litho equipment; to provide such a method which is relatively inexpensive and easily accomplished; to provide such a method which allows simple and inexpensive additon of multicolor offset printing; to provide such a method which offset prints at least two colors on one side of a web; to provide apparatus to accomplish the methods of the invention and the completed apparatus associated therewith; and to provide such methods and apparatus produced thereby, which are reliable, quickly operational and well suited for their intended purpose.

Other objects and advantages of this invention will become apparent from the following description taken in connection with the accompanying drawings wherein are set forth, by way of illustration and example, certain embodiments of this invention.

DETAILED DESCRIPTION OF THE PREFERRED EMBODIMENTS

Figure 1:
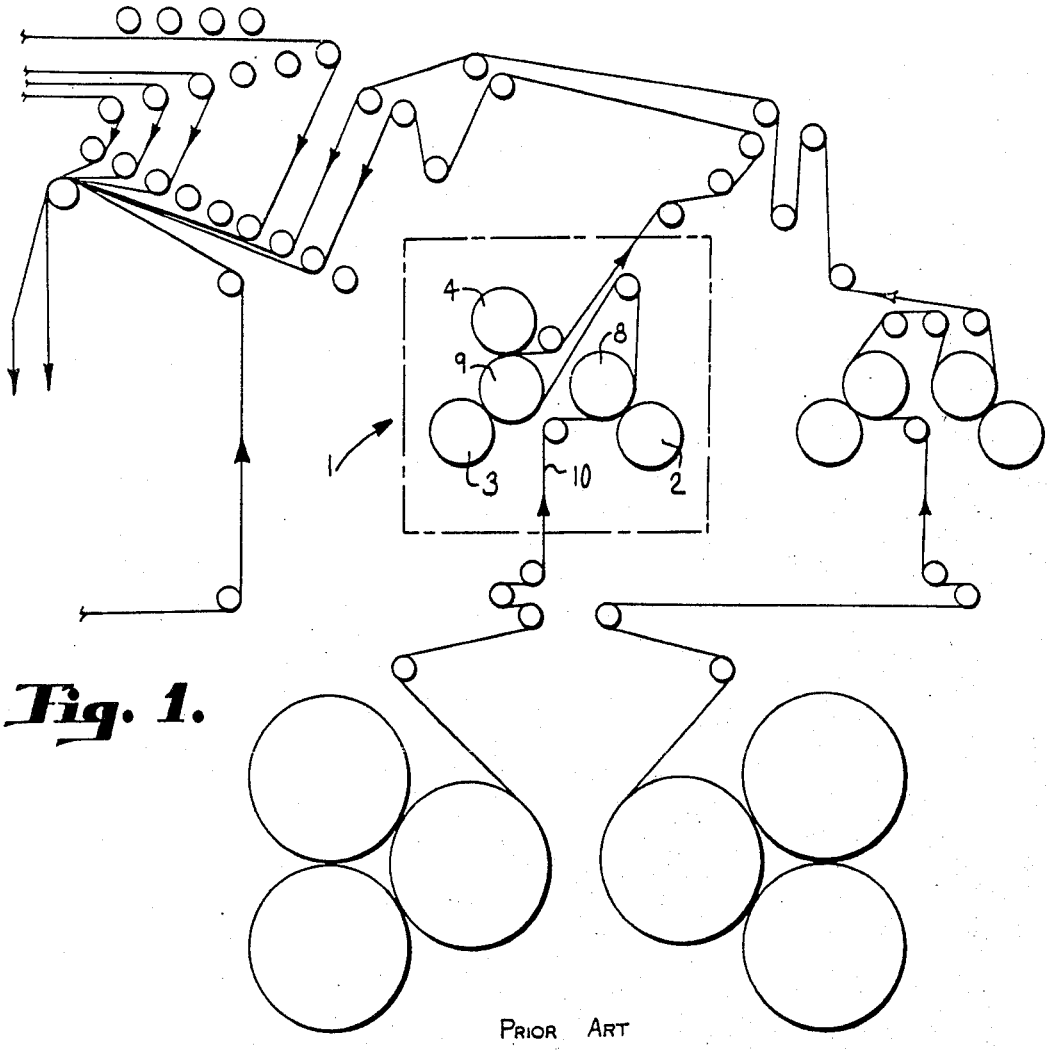
Fig. 1. Prior Art
FIG. 1 is a simplified, schematic elevational view of a typical section of prior art web letterpress equipment.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
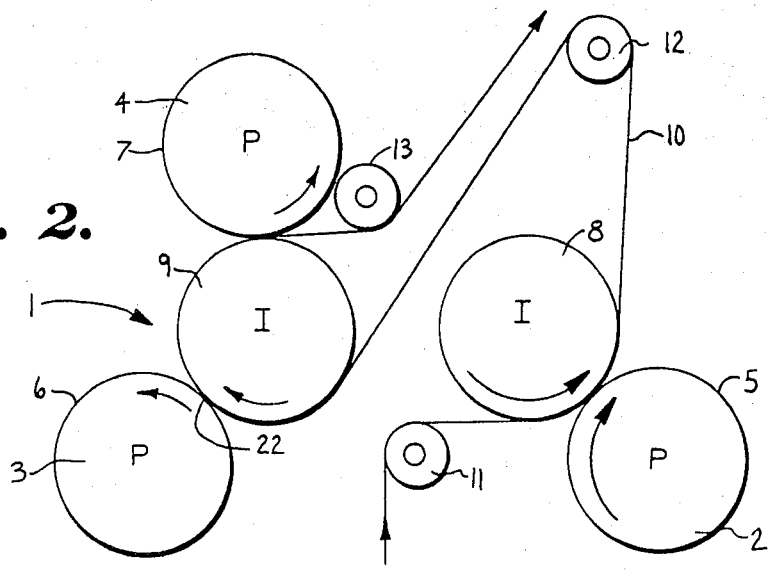
Fig. 2. Prior Art
FIG. 2 is a schematic illustration of a portion, or printing tower, of the prior art equipment of FIG. 1, enlarged from the broken line rectangle, illustrating a typical prior art web path in a printing unit having a color hump cylinder.

Referring to the drawings in more detail:

FIGS. 1 and 2 illustrate portions of typical prior art letterpress printing equipment 1 which includes letterpress printing or plate cylinders 2, 3 and 4 each having, respectively, printing plates 5, 6 and 7 secured in the usual manner to the surface thereof and suitably inked by well known apparatus, not shown. The letterpress plate cylinder 2 is associated with a letterpress blanket or impression cylinder 8 and the letterpress plate cylinders 3 and 4 are associated with a single letterpress blanket or impression cylinder 9. A web 10 passes over an idler or directing roller 11 and is wrapped, in this example, approximately ninety degrees about the blanket cylinder 8 from which it is directed to another idler or directing roller 12. From the roller 12 the web 10 is wrapped, in this example, approximately two hundred and forty degrees about the blanket cylinder 9, from which it passes about an idler roller 13 while traveling to another section of the equipment 1 for other operations such as further printing, collating with other webs, cutting, folding, etc. The printing cylinders 2, 3 and 4 simultaneously engage the web 10, which is supported by the blanket cylinders 8 and 9 and the ink image is thereby transferred by the respective plate cylinders to the web 10.

Various embodiments of the present invention are depicted in FIGS. 3, 4, 5, 6 and 7. Similar parts appearing in the modified embodiments of FIGS. 3, 4, 5, 6 and 7 and the prior art are represented by the same, corresponding reference numeral except for the addition of the suffixes "a", "b", "c", "d", or "e" respectively.

Figure 3:
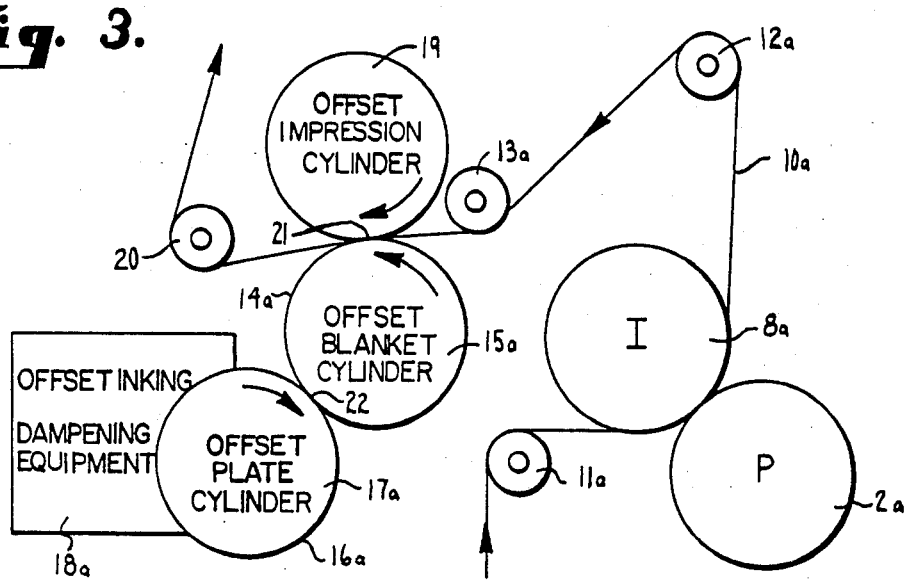
FIG. 3 is a view similar to that of FIG. 2 but showing an altered web path and cylinder identity as a result of one embodiment of the practice of this invention.

Referring to FIG. 3 in comparison with FIG. 2, by way of example in the practice of this invention, the letterpress impression cylinder 9 is suitably modified by known methods to receive an offset printing blanket **14*a*, thereby becoming an offset blanket cylinder 15*a*. The lower letterpress plate cylinder 3 is adapted through suitable known modifications to carry a lithographic offset plate 16*a*, thereby being converted into an offset plate cylinder 17*a*. Appropriate offset inking and dampening equipment 18*a* is associated with the plate cylinder 17*a* for supporting its intended function. The other letterpress plate cylinder 4, formerly the color hump cylinder, is appropriately packed so as to become an offset impression roll or cylinder 19 mating with the offset blanket cylinder 15*a***.

Conveying means such as an additional idler or directing roller 20 is desirably aligned with a juncture or bight 21 between the cylinders **15*a* and 19 for guiding the web therefrom. The web 10*a* may then be fed, with substantially less wrap than in the prior art letterpress equipment, about the center or offset blanket cylinder 15*a*however, if increased wrap is desired for registration purposes the position of the idler roller 20 may be suitably changed. The modified press of FIG. 3 is webbed so that no paper passes between the former printing bight 22 between the unmodified letterpress plate and impression cylinders 3 and 9, as seen in FIG. 2, since in the embodiment of this invention shown in FIG. 3, this becomes bight 22*a* which is the transfer line of the image from the offset plate cylinder 17*a* to the offset printing blanket 14*a*. The web 10*a* receives the offset image from the offset printing blanket 14*a* at the bight 21**.

In the example illustrated in FIG. 3, the three modified cylinders **15*a*, 17*a* and 19 are driven in the opposite direction from the prior art letterpress cylinders 9, 3 and 4 respectively to facilitate the new web path. Preferably, the offset impression cylinder 19 is positively driven and mechanically synchronized to the offset blanket cylinder 15*a* whereby the web engaging surfaces thereon move with the same velocity at the bight 21**.

Figure 4:
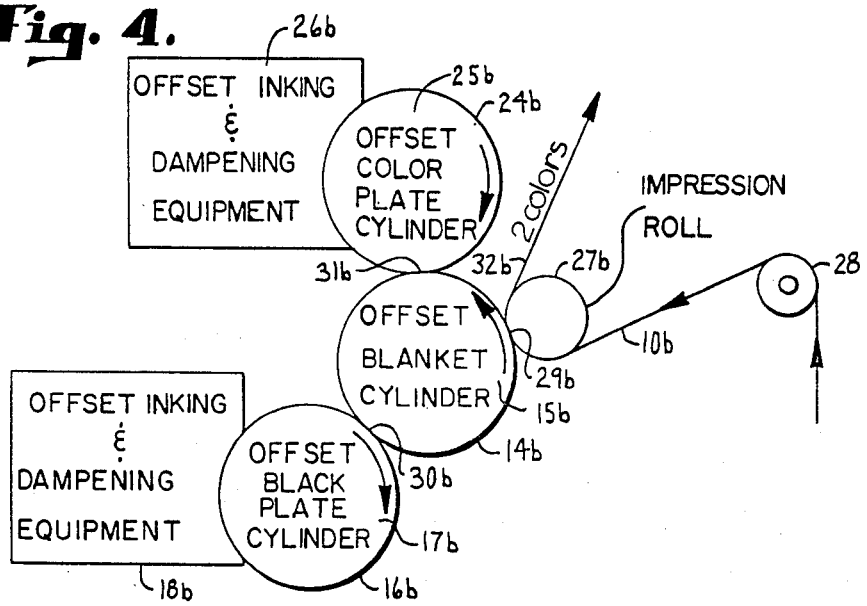
FIG. 4 is a view similar to that of FIG. 2 but showing an altered web path and cylinder identity as a result of a second embodiment of the practice of this invention.

Referring to FIG. 4 in comparison to FIGS. 2 and 3, a second embodiment of the present invention is shown wherein the letterpress plate cylinder 3 is converted to carry an offset plate **16*b*, thereby becoming an offset plate cylinder 17*b*, also referred to as an offset black plate cylinder, along with appropriate offset inking and dampening equipment 18***b*. The letterpress impression cylinder 9 is modified by known methods to receive an offset printing blanket 14*b* to produce offset blanket cylinder 15*b*. The other letterpress plate cylinder 4, formerly the color hump cylinder, is also converted by known methods to carry a second offset plate cylinder 24*b*, thereby becoming a second offset plate cylinder 25*b*, also referred to as an offset color plate cylinder. Appropriate offset inking and dampening equipment 26*b* is associated with the second offset plate cylinder 24*b*. An offset impression roll or cylinder 27*b* is placed adjacent the offset blanket cylinder 15*b* and cooperates therewith. The size and position of the offset impression cylinder 27*b* can be varied, as long as sufficient space therefor exists in the letterpress equipment being converted, wherein the impression cylinder 27*b* can be mounted. Preferably the impression cylinder 27*b* is positively driven, such that the surface thereof rotates at the same speed as the offset blanket cylinder 15*b*.

Figure 5:
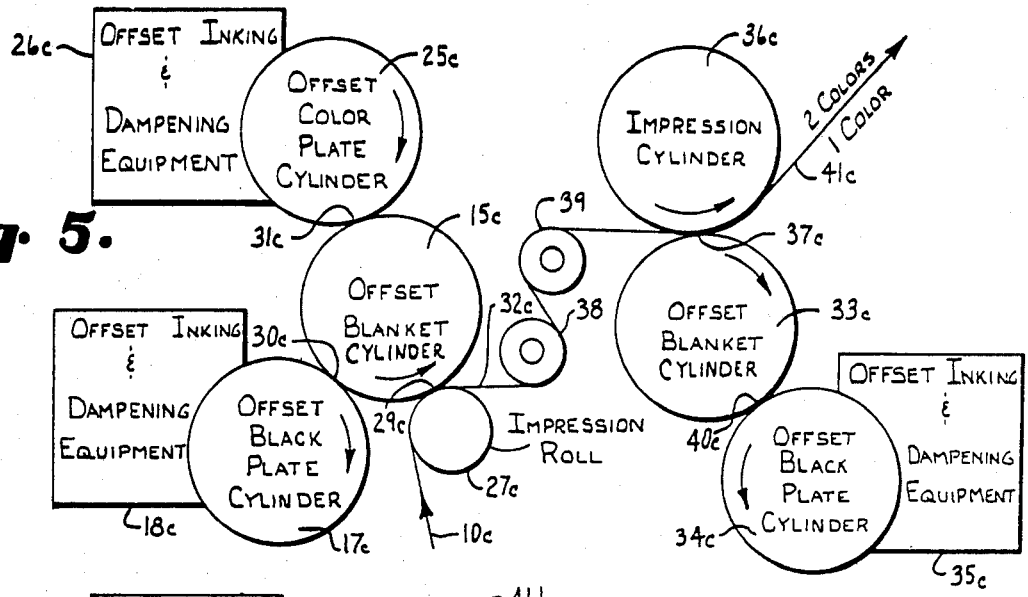
FIG. 5 is a view similar to that of FIG. 2 but showing an altered web path and cylinder identity as a result of a third embodiment of the practice of this invention.
Figure 6:
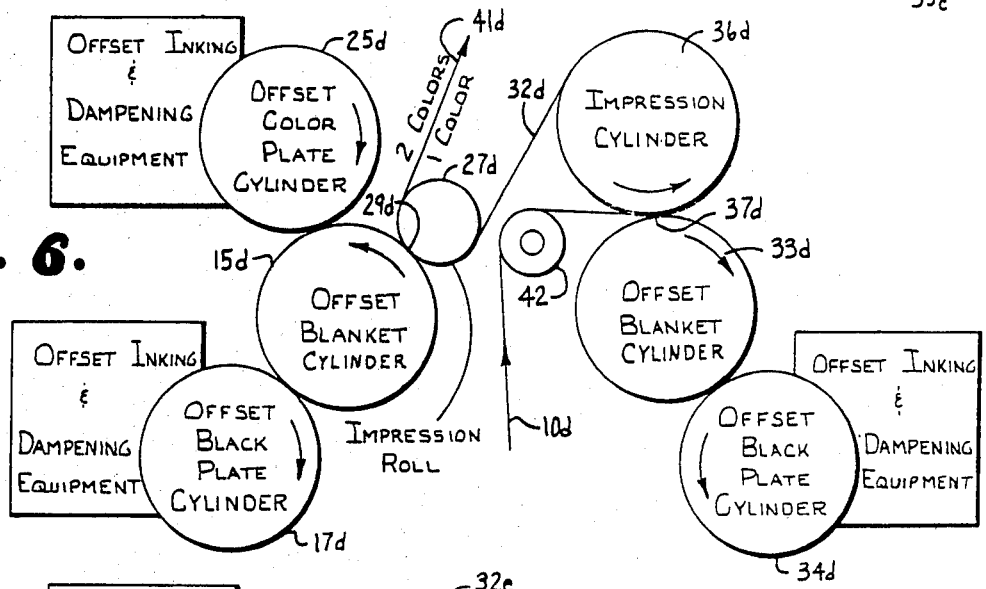
FIG. 6 is a view similar to that of FIG. 2 but showing an altered web path and cylinder identity as a result of a fourth embodiment of the practice of this invention.
Figure 7:
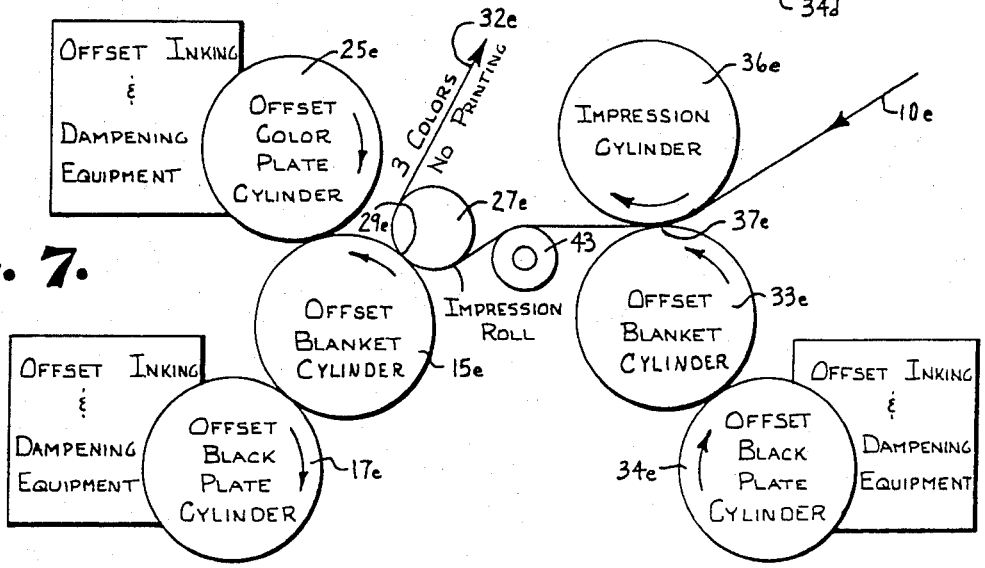
FIG. 7 is a view similar to that of FIG. 2 but showing an altered web path and cylinder identity as a result of a fifth embodiment of the practice of this invention.

In the embodiment shown in FIG. 4, a web 10*b* is guided by conveying means such as a suitable idler or directing roller 28 to the bight 29*b* between the offset blanket cylinder 15*b* and the offset impression cylinder 27*b*. Each offset cylinder 15*b*, 17*b* and 25*b* rotates in opposite direction as original letterpress cylinders 9, 3 and 4 respectively. An ink image is made upon each of the offset plate cylinders 17*b* and 25*b* by their respective inking and dampening equipment 18*b* and 26*b* respectively. Both ink images on the offset plate cylinders 17*b* and 25*b* are consequently transferred to the offset blanket cylinder 15*b* at bights 30*b* and 31*b* respectively. The image produced on the offset blanket cylinder 15*b* is thus multicolor provided that different color inks are used on the offset plate cylinders 17*b* and 25*b*. The multicolor image on the offset blanket cylinder 15*b* is then transferred to the web 10*b* at the bight 29*b*, whereupon one web printing side 32*b* has at least two colors offset printed thereon. Referring, in general, to FIGS. 5, 6 and 7, the embodiments shown therein generally depict conversions of printing presses from letterpress to offset printing with the presses comprising two generally horizontally opposed and spaced printing couples, generally referred to as 101*c, d* and *e* and 103*c, d* and *e* respectively. Specifically, in FIGS. 5–7, the converted printing couples 101*c, d* and *e* comprise offset black plate cylinders 17*c, d* and *e*; offset blanket cylinders 15*c, d* and *e*; offset color plate cylinders 25*c, d* and *e*; and offset impression cylinders 27*c, d* and *e*, respectively. The manner of converting printing couples 101*c, d* and *e* from a letterpress to an offset couple is generally as set forth before and will be explained in detail later.

The converted printing couples 103*c, d* and *e* comprises offset black plate cylinders 34*c, d* and *e*; offset blanket cylinders 33*c, d* and *e*; and offset impression cylinders 36*c, d* and *e*. Again, the method of converting printing couple 103*c, d* and *e* from a letterpress couple to an offset couple is generally as set forth before and will be explained in detail later.

From reviewing FIGS. 5, 6 and 7 it is seen that the offset plate cylinders, 17*c, d* and *e*; 25*c, d* and *e*; and 34*c, d* and *e*; along with offset blanket cylinders 15*c, d* and *e*; and 33*c, d* and *e*, have a same, first diameter. Further, it is seen that associated pairs of offset plate cylinders 17*c* and 34*c*, 17*d* and 34*d*, and 17*e* and 34*e* of each respective embodiment of FIGS. 5, 6 and 7 are spaced apart a first distance and an axis of rotation of the cylinders of each pair lie in a first, generally horizontal plane. From viewing the drawings it is also seen that pairs of blanket cylinders 15*c* and 33*c*, 15*d* and 33*d*, and 15*e* and 33*e* are spaced apart a distance which is less than the first distance and also less than the first diameter. Further, it is seen that an axis of rotation of the blanket cylinders comprising each pair lies in a second, generally horizontal plane spaced above the first horizontal plane aforementioned and parallel thereto. Also, the respective axes of rotation of each of cylinders 15*c, d* and *e*; and 33*c, d* and *e* lie within the axes of rotation of cylinders 17*c, d* and *e* and 34*c, d* and *e* such that a line passing through the axes of rotation cylinders 17*c, d* and *e* and 15*c, d* and *e* intersects a line passing through the axes of rotation of cylinders 34*c, d* and *e* and 33*c, d* and *e* at a point between the cylinders. This geometrical configuration and spacing generally conforms to the configuration of letterpress printing presses which are presently being used to print newspapers and which are converted to offset printing according to the method disclosed herein.

Generally, the offset color plate cylinders 25*c, d* and *e* each have an axis of rotation which is positioned above the second horizontal plane and which is generally between the axes of rotation of the respective offset blanket cylinders 15*c, d* and *e* and offset black plate cylinders 17*c, d* and *e*. It is envisioned that the axis of rotation of each offset color cylinder 25*c, d* and *e* can be directly above that of the respective offst black plate cylinders 17*c, d* and *e*.

Referring to the embodiment appearing in FIG. 5, the letterpress equipment is converted to offset equipment as described herein above for the embodiment in FIG. 4, such that offset black and color plate cylinders 17*c* and 25*c* have appropriate offset inking and dampening equipment 18*c* and 26*c* respectively and cooperate with an offset blanket cylinder 15*c* at bights 30*c* and 31*c* respectively. An impression roll or cylinder 27*c* is added which engages the offset blanket cylinder 15*c* at bight 29*c* slightly removed from such engagement in the previously described embodiment. In addition a second black letterpress plate cylinder 2 and a second letterpress impression cylinder 8, as seen in FIG. 2, are respectively converted to a second offset black plate cylinder 34*c* and a second offset blanket cylinder 33*c* respectively. Preferably the second offset impression black plate and blanket cylinder 34*c* and 33*c* are converted from letterpress equipment in the same press tower as or adjacent to said first offset black plate and blanket cylinders 17*c* and 15*c*. Appropriate offset inking and dampening equipment 35*c* is provided for the offset plate cylinder 34*c*. A second offset impression cylinder 36*c* cooperates with the offset blanket cylinder 33*c* at a bight 37*c* therebetween. A web 10*c* is suitably guided to the first impression cylinder 27*c* whereat a first web printing side 32*c* is multicolor offset printed as described for the embodiment in FIG. 4. The web 10*c* is also directed and properly registered by suitable conveying means such as idler or directing rollers 38 and 39 to the bight 37*c* between the second offset impression and blanket cylinder 36*c* and 33*c*. The second offset black plate cylinder 34*c* has an image transferred thereto by the inking and dampening equipment 35*c* which is thereafter transferred to the second offset blanket cylinder 33*c* at a bight 40*c* therebetween. This image is then transferred to a web second printing side 41*c* as the web 10*c* passes between the second offset impression cylinder 36*c* and second offset blanket cylinder 33*c* at bight 37*c*, whereby the web 10*c* has at least two colors offset printed on the web first printing side 32*c* and at least one color offset printed on the second printing side 41*c*. It is readily foreseen that the second offset impression cylinder 36*c* could also be a converted letterpress second plate cylinder which is part of a color hump. All offset cylinders of FIG. 5 rotate in reverse direction in comparison to their corresponding former unmodified letterpress cylinders.

Referring to the embodiment shown in FIG. 6, the letterpress equipment is converted to offset equipment substantially as described hereinabove with reference to the discussion about the embodiment appearing in FIG. 5, thereby producing offset first black and color plate cylinders 17*d* and 25*d* cooperating with a first offset blanket cylinder 15*d*, a first offset impression cylinder 27*d* engaging the first offset blanket cylinder 15*d* at bight 29*d*, a second offset black plate cylinder 34*d* cooperating with second offset blanket cylinder 33*d*, and a second offset impression cylinder 36*d* engaging the second offset blanket cylinder 33*d* at bight 37*d*.

A web 10*d* having first and second printing sides or surfaces 32*d* and 41*d* is directed by an idler or directing roller 42 to and between the second offset impression cylinder 36*d* and second offset blanket cylinder 33*d*receiving an image having at least one color therein transferred from the second offset blanket cylinder 33*d* to the web first printing 32*d*. The web 10*d* then partially wraps about the second offset impression cylinder 36*d* after which the web 10*d* is directed to the first offset impression cylinder 27*d* partially wrapping thereabout and passing between the first offset impression cylinder 27*d* and the first offset blanket cylinder 15*d* at bight 29*d*, whereupon the second web printing side engages the first offset blanket cylinder 15*d* and has offset printed thereupon an image having at least two colors therein. It is foreseen that the web 10*d* could be guided through a number of somewhat altered paths to produce the described offset images thereon. All offset cylinders of FIG. 6 rotate in reverse direction in comparison to their corresponding former unmodified letterpress cylinders.

Referring to the embodiment depicted in FIG. 7, the letterpress equipment is again converted to offset equipment substantially as described in the discussion regarding the embodiment shown in FIG. 5, thereby producing offset first black and color plate cylinders 17*e* and 25*e* cooperating with a first offset blanket cylinder 15*e*, a first offset impression cylinder 27*e* engaging the first offset blanket cylinder 15*e* at bight 29*e*, a second offset black plate cylinder 34*e*, and a second offset impression cylinder 36*e* engaging a second offset blanket cylinder 33*e* at bight 37*e*.

A web 10*e* having a first printing side 32*e* thereon is suitably directed to pass between the second offset impression cylinder 36*e* and the second offset blanket cylinder 33*e* at bight 37*e* with the first printing side 32*e* engaging and receiving an offset printed image from the offset blanket cylinder 33*e*. The web 10*e* is also directed by suitable guides such as an idler or director roller 43 to pass between the first offset impression cylinder 27*e* and first offset blanket cylinder 15*e*, partially wrapping about the former, with the web first printing side 32*e* engaging the first offset blanket cylinder 15*e* at bight 29*e*, whereupon an image having two additional colors is offset printed thereupon. Thus the web first printing side 32*e* has at least a three color image printed thereon. (It should be noted that although both offset plate cylinders 34*e* and 17*e* are referred in the trade as "black", the term is not meant to limit such cylinders to printing only the color black. Thus either or both cylinders 17*e* and 34*e* may produce an image color other than black transferred therefrom.) The offset first black and color plate cylinders 17*e* and 25*e* and the first offset blanket cylinder 15*e* of the embodiment shown in FIG. 7 rotate in reverse direction to their corresponding former unmodified letterpress cylinders.

Thus, the relatively simple modifications above noted allow existing letterpress equipment, and particularly web letterpress, to be easily and inexpensively changed to offset printing capability having the advantage of higher printing quality in conjunction with the convenience and savings offered thereby. In addition, the equipment converted to offset printing according to this invention can be used to easily print in multiple colors on a printing web.

It is to be understood that while certain embodiments of this invention have been illustrated and described herein, it is not to be limited thereto except insofar as such limitations are included in the following claims.

What is claimed and desired to secure by Letters Patent is:

1. The process of permanently modifying conventional, continuous web letterpress newspaper printing equipment having cooperating first and second horizontally spaced sets of printing couples each comprising a letterpress impression and plate cylinder from letterpress printing equipment to continuous web offset equipment; said letterpress couples having a fixed spacing therebetween; said process including the steps of:

(a) permanently modifying the first letterpress plate cylinder to accept an offset plate and thereby function as a first offset plate cylinder having a first diameter; said first offset plate cylinder generally being positioned in said tower at the same location as said first letterpress plate cylinder was located;

(b) permanently modifying said first letterpress impression cylinder to accept an offset blanket and thereby function as a first offset blanket cylinder having a diameter generally equal to said first diameter; said first offset blanket cylinder generally being positioned in said tower at the same location as said first letterpress impression cylinder was located;

(c) permanently modifying said second letterpress plate cylinder to an offset plate cylinder to thereby function as a second offset plate cylinder having a diameter generally equal to said first diameter; said second offset plate cylinder generally being positioned in said tower at the same location as said second letterpress plate cylinder was located;

(d) permanently modifying said second letterpress impression cylinder to accept an offset blanket and thereby function as a second offset blanket cylinder having a diameter generally equal to said first diameter; said second offset blanket cylinder generally being positioned in said tower at the same location as said second letterpress impression cylinder was located;

(e) said first and second offset blanket cylinders being positioned within said tower frame such that they are generally horizontally opposed and spaced apart a distance less than said first diameter;

(f) said first and second offset plate cylinders being positioned in tangential contact with respective first and second offset blanket cylinders;

(g) positioning dampening and inking equipment in cooperation with said first offset plate cylinder;

(h) positioning dampening and inking equipment in cooperation with said second offset plate cylinder;

(i) permanently positioning a first offset impression cylinder in tangential contact with said first offset blanket cylinder at a first bight spaced from said first offset plate cylinder; said first offset cylinder being an added cylinder having a diameter substantially smaller than said first diameter and being positioned such that the axial center of said first impression cylinder is between vertical planes passing through axial centers of said first and second offset plate cylinders;

(j) rotating said first offset impression cylinder such that the speed of the surfaces of said first offset impression cylinder and said first offset blanket cylinder at said first bight are substantially the same;

(k) permanently positioning a second offset impression cylinder in tangential contact with said second offset blanket cylinder at a second bight spaced from said second plate cylinder;

(l) rotating said second offset impression cylinder such that the speed of the surfaces of said second impression cylinder and said second offset blanket cylinder at said second bight are substantially the same; and (m) reeving a continuous web between said first bight so as to pass between said first offset blanket cylinder and said first offset impression cylinder and said second bight so as to pass between said second impression cylinder and said second offset blanket cylinder at said second bight.

2. The process according to claim 1 including the step of:

(a) positioning the center of said first offset impression cylinder between vertical planes passing through the centers of said first and second offset plate cylinders.

3. The process according to 1 or 2 including the step of:

(a) reversibly reeving said web between said first bight between said first offset blanket and impression cylinders while substantially wrapping about said first offset impression cylinder and thereafter said web to pass through said second bight between said second offset impression and blanket cylinders.

4. The process according to claim 3 including the step of:

(a) adding a third offset plate cylinder to cooperate with said first offset blanket cylinder so as to transfer a third image thereto and so as to print in color on at least one side of said web in cooperation with the image transferred to said first offset blanket cylinder from said first offset plate cylinder.

5. The process according to claim 4 including the step of:

(a) converting a letterpress color hump plate cylinder originally cooperating with said first letterpress impression cylinder to said third offset plate cylinder while substantially retaining the same relative position within the tower frame between the letterpress color hump plate cylinder and the third offset plate cylinder.

* * * * *